US010868621B1

(12) United States Patent
Venezia

(10) Patent No.: US 10,868,621 B1
(45) Date of Patent: Dec. 15, 2020

(54) CONNECTED RADIO LOCAL, ISOLATED, AND HYBRID IMPLEMENTATION

(71) Applicant: Ibiquity Digital Corporation, Columbia, MD (US)

(72) Inventor: Paul Venezia, Keene, NH (US)

(73) Assignee: Ibiquity Digital Corporation, Columbia, MD (US)

( * ) Notice: Subject to any disclaimer, the term of this patent is extended or adjusted under 35 U.S.C. 154(b) by 0 days.

(21) Appl. No.: 16/594,869

(22) Filed: Oct. 7, 2019

(51) Int. Cl.
*H04H 60/42* (2008.01)
*H04H 60/74* (2008.01)

(52) U.S. Cl.
CPC ..... *H04H 60/74* (2013.01); *H04H 60/42* (2013.01)

(58) Field of Classification Search
CPC ..... H04H 60/74; H04H 60/42
USPC ..... 455/185.1, 3.01, 3.04, 3.02
See application file for complete search history.

(56) References Cited

U.S. PATENT DOCUMENTS

| | | | | |
|---|---|---|---|---|
| 5,393,713 | A | 2/1995 | Schwob | |
| 6,501,421 | B1 | 12/2002 | Dutta et al. | |
| 6,628,928 | B1 | 9/2003 | Crosby et al. | |
| 6,650,902 | B1 | 11/2003 | Richton | |
| 10,187,453 | B2 * | 1/2019 | Deeming | H04L 67/10 |
| 2001/0047298 | A1 * | 11/2001 | Moore | H04N 21/2353 705/14.4 |
| 2003/0040272 | A1 | 2/2003 | Lelievre et al. | |
| 2005/0060741 | A1 * | 3/2005 | Tsutsui | H04N 21/4722 725/32 |
| 2009/0290519 | A1 * | 11/2009 | Griffin, Jr. | H04B 1/086 370/310 |
| 2011/0010301 | A1 * | 1/2011 | Tsuruga | G06Q 50/184 705/310 |
| 2014/0195675 | A1 * | 7/2014 | Silver | H04W 56/0005 709/224 |
| 2015/0082338 | A1 * | 3/2015 | Logan | H04N 21/4825 725/32 |
| 2016/0157061 | A1 * | 6/2016 | Littlejohn | H04N 21/44209 455/456.3 |

FOREIGN PATENT DOCUMENTS

| | | | |
|---|---|---|---|
| GB | 2427289 | A | 12/2006 |
| WO | WO-2019032453 | A1 | 2/2019 |

OTHER PUBLICATIONS

"International Application Serial No. PCT/US2019/055008, International Search Report dated Jul. 2, 2020", 3 pgs.
"International Application Serial No. PCT/US2019/055008, Written Opinion dated Jul. 2, 2020", 5 pgs.

* cited by examiner

*Primary Examiner* — Sonny Trinh
(74) *Attorney, Agent, or Firm* — Schwegman Lundberg & Woessner, P.A.

(57) ABSTRACT

A radio receiver comprises radio frequency (RF) receiver circuitry that receives a radio broadcast signal, an Internet network interface, a display, a memory, processing circuitry, and a client application including instructions for execution by the processing circuitry. The client application is configured to: determine geographic location information of the radio receiver; determine radio broadcasts that are available to the radio receiver using the geographical location information; select metadata, from metadata stored in the memory, that is associated with the radio broadcasts available to the radio receiver; and present information included in the selected metadata using the display according to the received radio broadcast signal.

19 Claims, 3 Drawing Sheets

CONNECTED RADIO LOCAL, ISOLATED, AND HYBRID IMPLEMENTATION

TECHNICAL FIELD

The technology described in this patent document relates to systems and methods for providing supplemental data (e.g., metadata) that is associated with over-the-air radio broadcast signals.

BACKGROUND

Over-the-air radio broadcast signals are used to deliver a variety of programming content (e.g., audio, etc.) to radio receiver systems. Such over-the-air radio broadcast signals can include conventional AM (amplitude modulation) and FM (frequency modulation) analog broadcast signals, digital radio broadcast signals, hybrid radio signals that include both analog and digital broadcast signals, or other broadcast signals. Service data that includes multimedia programming can be included with radio broadcasts. The broadcast of the service data may be contracted by companies to include multimedia content associated with primary or main radio program content.

Another approach to provide service data is to combine over-the-air (OTA) broadcast radio information with Internet Protocol (IP) delivered content to provide an enhanced user experience. An example of this type of radio service is DTS® Connected Radio™ service, which combines over-the-air analog/digital AM/FM radio with IP delivered content. The combined OTA and IP radio service receives radio broadcast audio, which is then paired with IP-delivered content (such as artist information and song title, logos, slogans, on-air radio program information and station contact information sourced directly from radio broadcasters) and displayed on radio receivers in vehicles. The radio receivers of the vehicles integrate data from Internet services with broadcast audio to create a rich media experience. However, there may be cases where connection to the Internet is not available to vehicles.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In general, when access to the Internet is not available to a radio receiver for full connected radio service, embodiments of the local, isolated, or hybrid implementations of connected radio determine the radio broadcasts that are available to the radio receiver using geographical location information determined by the receiver. Instead of receiving metadata for the broadcasts via an Internet connection, the radio receiver analyzes and selects metadata stored in memory of the radio receiver to present with tuned-in radio broadcasts. The metadata is associated with the radio broadcasts that were determined by the radio receiver to be available. A connected radio experience can still be provided to the user although the experience is less featureful than what is provided by a constantly connected radio service.

It should be noted that alternative embodiments are possible, and steps and elements discussed herein may be changed, added, or eliminated, depending on the particular embodiment. These alternative embodiments include alternative steps and alternative elements that may be used, and structural changes that may be made, without departing from the scope of the invention.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
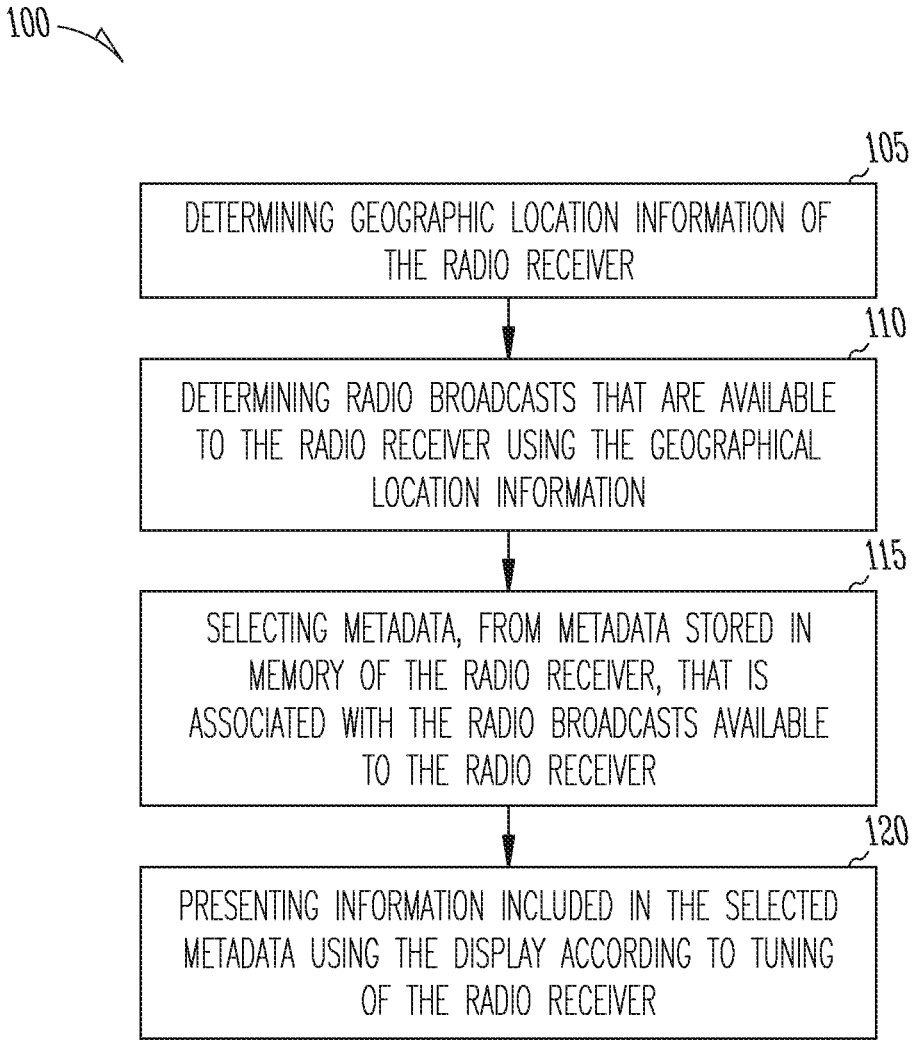
FIG. 1 is a flow diagram of an example of a method of operating a radio receiver that receives over-the-air radio broadcasts and Internet Protocol delivered content.

In the following description of embodiments of a metadata distribution system, reference is made to the accompanying drawings. These drawings shown by way of illustration specific examples of how embodiments of the metadata distribution system may be practiced. It is understood that other embodiments may be utilized, and structural changes may be made without departing from the scope of the claimed subject matter.

Over-the-air radio broadcast signals are commonly used to deliver a variety of programming content (e.g., audio, etc.) to radio receiver systems. Main program service (MPS) data and supplemental program service (SPS) data can be provided to radio broadcast receiver systems. Metadata associated with the programming content can be delivered in the MPS data or SPS data via the over-the-air radio broadcast signals. The metadata can be included in a sub-carrier of the main radio signal. In IBOC radio, the radio broadcast can be a hybrid radio signal that may include a streamed analog broadcast and a digital audio broadcast. Sub-carriers of the main channel broadcast can include digital information such as text or numeric information, and the metadata can be included in the digital information of the sub-carriers. Thus, a hybrid over-the-air radio broadcast can include an analog audio broadcast, a digital audio broadcast, and other text and numeric digital information such as metadata streamed with the over-the-air broadcast. The programming content may be broadcast according to the DAB standard, the digital radio mondiale (DRM) standard, radio data system (RDS) protocol, the radio broadcast data system (RBDS) protocol, or a high definition (HD) IBOC radio protocol.

The metadata can include both "static" metadata and "dynamic" metadata. Static metadata changes infrequently or does not change. The static metadata may include the radio station's call sign, name, logo (e.g., higher or lower logo resolutions), slogan, station format, station genre, language, web page uniform resource locator (URL), URL for social media (e.g., Facebook, Twitter), phone number, short message service (SMS) number, SMS short code, program identification (PI) code, country, or other information.

Dynamic metadata changes relatively frequently. The dynamic metadata may include a song name, artist name, album name, album image, artist image (e.g., related to content currently being played on the broadcast), advertisements, enhanced advertisements (e.g., title, tag line, image, phone number, SMS number, URL, search terms), program schedules (image, timeframe, title, artist name, DJ name, phone number, URL), on-air radio program information, station contact information, service following data, or other information. When the radio receiver system is receiving an over-the-air radio broadcast signal from a particular radio station, the receiver system may receive both static metadata and dynamic metadata.

As explained previously herein, combining OTA radio broadcasts with Internet Protocol (IP) delivered content is another approach to provide service data to radio receivers. Combining over-the-air analog/digital AM/FM radio with IP delivered content provides an enhanced user experience. The combined OTA-IP radio service receives dynamic metadata directly from local radio broadcasters, which is then retrieved by the radio receiver via IP, paired with broadcast content, and displayed in vehicles.

The radio receivers of the vehicles integrate data from Internet services with broadcast audio to create a rich media experience. The preferred implementation of combined OTA-IP radio service is one that provides full features via an active Internet connection, with data based on the current geographic location of the radio receiver. A client application program or "client" executing on the Internet connected radio receiver sends location information (e.g., GPS coordinates) via the Internet connection to an Internet service that may perform mathematical and geospatial functions on a large dataset consisting of AM, FM, HD Radio, and DAB radio broadcasts to determine metadata (e.g., dynamic metadata) that is available to radio receivers tuned to the radio broadcasts. Based on the location information from the radio receiver, the Internet service returns metadata pertaining to the radio broadcasts that are available to the radio receiver. The dataset of radio broadcasts changes often as broadcasters change radio transmitters, radio transmission types, bring new radio stations on the air and take other radio stations off the air, and rebrand existing radio stations. The dataset used by a combined OTA-IP radio service may constantly be updated with the current data so that the radio receiver has access to the most current information and the most current metadata.

However, there may be situations where a connection to the Internet is not available to an in-vehicle radio receiver, or there may be situations where the client of the radio receiver is prevented from sending its location to the Internet service. For these situations, it may be desirable to implement an isolated OTA-IP radio service, a local OTA-IP radio service, or hybrid of isolated and local OTA-IP radio services at the radio receiver. These versions of the combined OTA-IP radio service provide a subset of the services available from the full feature implementation of combined OTA-IP radio service. These versions may be substandard as compared to a full implementation, but provide combined OTA-IP radio service within the confines of the functionality available or regulatory restrictions imposed on the radio receiver.

FIG. 1 is a flow diagram of a method of operating a radio receiver that receives OTA radio broadcasts and IP delivered content. The method 100 may be performed by a client executed by processing circuitry of the radio receiver. The client of the radio receiver may perform the method when an Internet connection is unavailable to the radio receiver or the radio receiver cannot send location information (e.g., due to regulatory restrictions or option of the user). The radio receiver includes a memory to store metadata for radio broadcasts. The metadata can include both static and dynamic metadata, but the metadata may be a subset of what can be provided by the Internet service.

At 105, geographic location information of the radio receiver is determined. For example, the radio receiver may include a GPS receiver and the geographic location information can include GPS coordinates. At 110, the radio receiver (instead of an Internet service) uses the location information to determine the radio broadcasts that are available to the radio receiver and the stored metadata associated with the radio broadcasts. In certain embodiments, the radio broadcasts and the selected metadata may be associated with all the radio broadcasts available in the country in which the radio receiver is located, or in a smaller specific region of the world in which the radio receiver is located. In variations, the radio broadcasts and the selected metadata may be associated with the radio broadcasts available for the continent in which the radio receiver is located, or may be associated with the radio broadcasts available globally.

At 115, the client selects the metadata according to one or both of the location information and tuning of the radio receiver to select metadata from the metadata that is stored in the memory of the radio receiver. This is effectively the same Internet service provided by the full feature Internet connected version, but the service is implemented locally at the radio receiver without the need for an active Internet connection. At 120, the information included in the selected metadata is displayed to the user according to tuning of the radio receiver.

Figure 2:
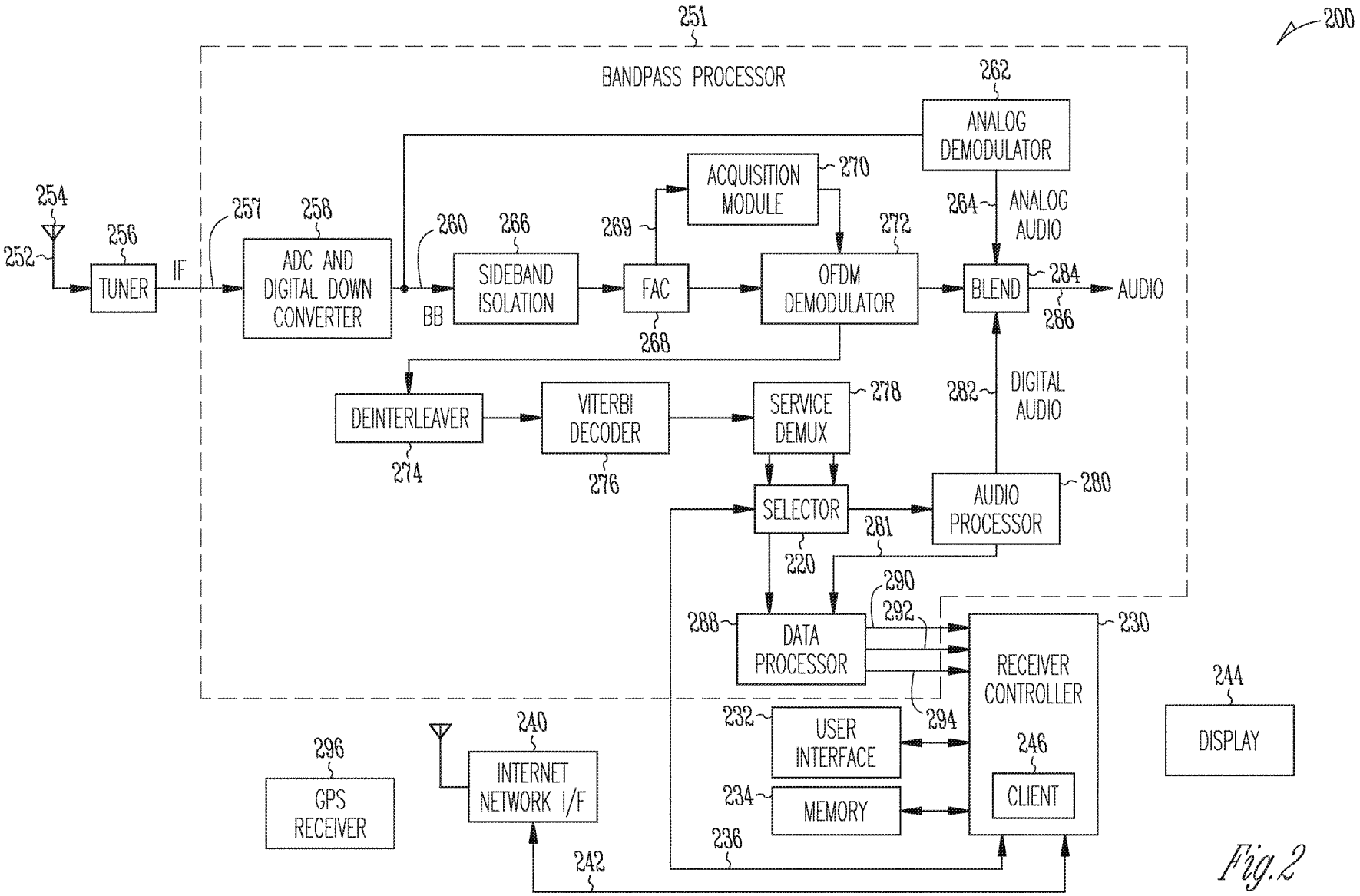
FIG. 2 is a block diagram of portions of an example of a radio receiver.

FIG. 2 is a block diagram of portions of an example of a radio receiver that receives OTA radio broadcasts and IP delivered content. In certain variations, the radio receiver is a DTS Connected Radio receiver. The radio receiver 200 may be the radio receiver of a vehicle. The radio receiver 200 includes a wireless Internet network interface 240 for receiving metadata via wireless IP and other components for receiving over-the-air radio broadcast signals. The Internet network interface 240 and receiver controller 230 may be collectively referred to as a wireless internet protocol hardware communication module of the radio receiver.

The radio receiver 200 includes radio frequency (RF) receiver circuitry including tuner 256 that has an input 252 connected to an antenna 254. The antenna 254, tuner 256, and baseband processor 251 may be collectively referred to as an over-the-air radio broadcast hardware communication module of the radio receiver. The RF circuitry is configured to receive audio broadcast signal that includes a digital audio file.

Within the baseband processor 251, an intermediate frequency signal 257 from the tuner 256 is provided to an analog-to-digital converter and digital down converter 258 to produce a baseband signal at output 260 comprising a series of complex signal samples. The signal samples are complex in that each sample comprises a "real" component and an "imaginary" component. An analog demodulator 262 demodulates the analog modulated portion of the baseband signal to produce an analog audio signal on line 264. The digitally modulated portion of the sampled baseband signal is filtered by isolation filter 266, which has a pass-band frequency response comprising the collective set of subcarriers $f_1$-$f_n$ present in the received OFDM signal. First adjacent canceller (FAC) 268 suppresses the effects of a first-adjacent interferer. Complex signal 269 is routed to the input of acquisition module 270, which acquires or recovers OFDM symbol timing offset/error and carrier frequency offset/error from the received OFDM symbols as represented in received complex signal 269. Acquisition module 270 develops a symbol timing offset $\Delta t$ and carrier frequency offset Δf, as well as status and control information. The signal is then demodulated (block 272) to demodulate the digitally modulated portion of the baseband signal. The digital signal is de-interleaved by a de-interleaver 274, and decoded by a Viterbi decoder 276. A service de-multiplexer 278 separates main and supplemental program signals from data signals. The supplemental program signals may include a digital audio file received in an IBOC DAB radio broadcast signal.

An audio processor 280 processes received signals to produce an audio signal on line 282 and MPSD/SPSD 281. In embodiments, analog and main digital audio signals are blended as shown in block 284, or the supplemental program signal is passed through, to produce an audio output on line 286. A data processor 288 processes received data signals and produces data output signals on lines 290, 292, and 294. The data lines 290, 292, and 294 may be multiplexed together onto a suitable bus such as an $I^2c$, SPI, UART, or USB. The data signals can include, for example, data representing the metadata to be rendered at the radio receiver.

The wireless Internet network interface may be managed by the receiver controller 230. As illustrated in FIG. 2, the Internet network interface 240 and the receiver controller 230 are operatively coupled via a line 242, and data transmitted between the Internet network interface 240 and the receiver controller 230 is sent over this line 242. A selector 220 may connect to receiver controller 230 via line 236 to select specific data received from the Internet network interface 240. The data may include metadata (e.g., text, images, video, etc.), and may be rendered at substantially the same time that primary or supplemental programming content received over-the-air in the IBOC DAB radio signal is rendered.

The receiver controller 230 receives and processes the data signals. The receiver controller 230 may include a microcontroller that is operatively coupled to the user interface 232 and memory 234. The microcontroller may be an 8-bit RISC microprocessor, an advanced RISC machine 32-bit microprocessor, or any other suitable microprocessor or microcontroller. Additionally, a portion or all of the functions of the receiver controller 230 could be performed in a baseband processor (e.g., the audio processor 280 and/or data processor 288). The user interface 232 may include input/output (I/O) processor that controls the display, which may be any suitable visual display such as an LCD or LED display. In certain embodiments, the user interface 232 may also control user input components via a touch-screen display. In certain embodiments, the user interface 232 may also control user input from a keyboard, dials, knobs or other suitable inputs. The memory 234 may include any suitable data storage medium such as RAM, Flash ROM (e.g., an SD memory card), and/or a hard disk drive. The radio receiver 200 may also include a GPS receiver 296 to receive GPS coordinates.

The processing circuitry of the receiver controller 230 is configured to perform instructions included in a client 246 installed in the radio receiver 200. The client 246 determines the geographic location of the radio receiver, such as by using the GPS receiver 296 for example. Using the geographic location, the client 246 determines radio broadcasts that are available to the radio receiver. The client 246 may perform the same mathematical and spatial functions on the local dataset that the Internet service performs on the full dataset. For example, the client 246 may perform an R-tree calculation or similar calculation on the local dataset to determine the radio broadcasts that are available to the radio receiver.

The client selects metadata from the dataset stored in memory that is associated with the radio broadcasts available to the radio receiver for presentation to the user using the display 244. The metadata may be selected from static metadata stored in the memory. Image assets (e.g., radio station logos) may be stored in the memory and the client selects image assets for display according to the available radio broadcasts and tuning of the radio receiver.

As explained above, the service implemented locally by the client 246 is effectively the same Internet service provided by the full feature Internet connected version, but it works from a smaller local data set that is stored in memory 234. The dataset may be a baseline dataset delivered with the radio service, and updates to the local dataset can be performed periodically. In some embodiments, the client is configured to detect when access to an Internet network is available. The Internet network access may be a home Internet network, an Internet network link provided by a user's smartphone, or a network accessible at an automotive service center. The client 246 initiates downloading of updated metadata via the Internet network interface and stores the downloaded metadata in the memory in response to detecting that access to the Internet network is available.

In certain embodiments, the client initiates the downloading and storing of metadata via the Internet network interface in response to a prompt received at the radio receiver. In certain embodiments, the radio receiver includes a port (e.g., a universal serial bus (USB) port, or other communication port) and the metadata can be downloaded to the memory 234 via the port when the vehicle is serviced. For these types of embodiments, the Internet network interface 240 may be a wired interface.

The client may send a query to a metadata service application via the Internet interface in response to the detecting that Internet access is available. If the receiver is restricted from sending location information, the geographic location information may be excluded from the query. The local dataset may be downloaded to the radio receiver according to an identifier or a subscription identifier provided by the client to determine the dataset for downloading to the radio receiver.

The radio receiver may receive dynamic metadata in response to a query that does not include the location information, and uses identifiers present in the local data set for geolocation. The identifiers may uniquely identify every radio broadcast allowing the geolocation information to be deduced from the identifiers. The radio receiver may present information included in the received dynamic metadata and metadata selected from metadata stored locally in memory of the radio receiver according to a received radio broadcast or according to tuning of the radio receiver. Other content in addition to the dynamic metadata can be received in response to the query, such as other static metadata and services. This hybrid functionality allows pairing of IP services with metadata of a local dataset to approximate full feature functionality without requiring the radio receiver to send geographic location information.

In some embodiments, the baseline dataset is updated with new data in response to the client sending a request to a metadata service application when the Internet access is detected. Only the new information is sent in order to make the transfer bandwidth-efficient. In an illustrative example intended to be non-limiting, the request for the update can include a timestamp (e.g., 2018-11-01T13:35.30.813131+

00:00) to identify the requested metadata and excludes the geographic location information. The metadata service application would deliver a dataset that contains only the necessary additions and deletions of data since that timestamp, and the receiver memory will have the current data. Image assets may be updated at the same time. In some embodiments, the client 246 flags or otherwise identifies one or more portions of the metadata stored in the memory as expired after a specified time after the metadata is stored in the memory without updates and excludes the expired metadata from the metadata selected for presentation to the user.

Figure 3:
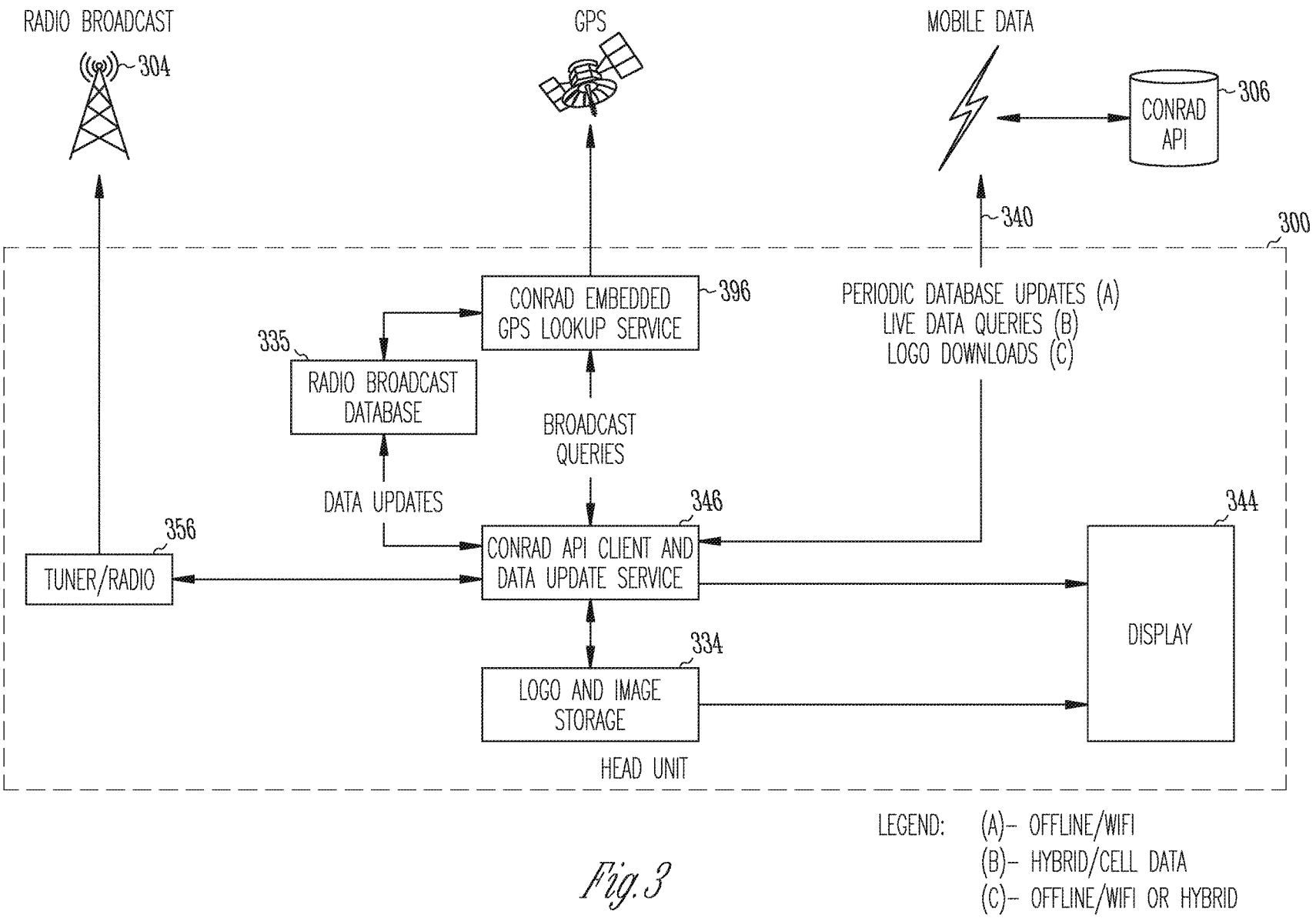
FIG. 3 is a block diagram of portions of another example of a radio receiver or head unit.

FIG. 3 is a block diagram of portions of another example of a radio receiver or head unit 300. The head unit 300 includes radio tuner circuitry 356 to receive a radio broadcast signal 304, a display 344 and a memory. The memory may include any suitable data storage medium for storage of logo and other image data 334, and for storage of a radio broadcast database 335 that may store metadata for radio broadcasts. The head unit 300 also includes a wireless Internet network interface 340 for communication with a server 306. The wireless Internet network interface 340 may communicate information using one or both of a WiFi network and a cellular phone network.

The server 306 includes an application program interface (API) and the head unit 300 includes an API Client 346 that includes a Data Update Service. The API Client 346 may be executed by processing circuitry of the head unit 300. The processing circuitry may also perform a GPS Lookup Service 396 to determine geographic location information.

The API Client 346 may control operation of the radio receiver according to the method of FIG. 1. The API Client 346 may receive specified types of data for radio broadcasts according to the mode that the wireless Internet interface 340 is operating. For example, the head unit 300 may receive updates to the radio broadcast database periodically using a detected WiFi network when the interface is an offline mode and not communicating using a cellular network. The radio broadcast database 335 is updated with the received data using the Data Update Service of the API. This data can include metadata for a radio broadcast that can be displayed when head unit is tuned to the broadcast even though the metadata is not received live during the broadcast.

In another example, the head unit 300 may perform or service live data queries when the interface is operating in a hybrid mode in which data can be received using one or both of a WiFi network or a cellular network. The live data can be used to display metadata associated with live radio broadcasts. In another example, the head unit 300 may receive logo data when the interface is operating in either the offline mode or the hybrid mode.

The API Client 346 may perform broadcast queries using the GPS Lookup Service to determine the broadcasts that are available. Metadata for the broadcasts can be retrieved from memory without the head unit 300 having to send location information (e.g., GPS information) to obtain the metadata. The metadata retrieval service is implemented locally at the head unit 300 without the need for an active connection to a cellular network of the Internet.

The systems, devices, and methods described permit a radio receiver to emulate an Internet connected radio experience for the user even though connection to the Internet is not available to an in-vehicle radio receiver, or the radio receiver is prevented from sending its location to an Internet service.

I. ALTERNATE EMBODIMENTS AND EXEMPLARY OPERATING ENVIRONMENT

Example 1 includes subject matter (such as a radio receiver) comprising radio frequency (RF) receiver circuitry configured to receive a radio broadcast signal, an Internet network interface, a display, a memory, processing circuitry, and a client application including instructions for execution by the processing circuitry. The client application is configured to determine geographic location information of the radio receiver; determine radio broadcasts that are available to the radio receiver using the geographical location information; select metadata, from metadata stored in the memory, that is associated with the radio broadcasts available to the radio receiver; and present information included in the selected metadata using the display according to the received radio broadcast signal.

In Example 2, the subject matter of Example 1 optionally includes a client application configured to detect when access to an Internet network is available, initiate downloading of metadata via the Internet network interface, and store downloaded metadata in the memory in response to detecting that access to the Internet network is available.

In Example 3, the subject matter of Example 2 optionally includes a client application configured to initiate downloading of metadata via the Internet network interface and storing of downloaded metadata in the memory in response to a prompt received at the radio receiver.

In Example 4, the subject matter of one or both of Examples 2 and 3 optionally include a client application configured to initiate sending a query to a metadata service application via the Internet interface in response to the detecting that Internet access is available, wherein the query requests metadata for download to the radio receiver and excludes the geographic location information for the radio receiver.

In Example 5, the subject matter of one or any combination of Examples 2-4 optionally includes a client application configured to send a request to a metadata service application via the Internet interface for an update of metadata according to the determined geographic location information in response to detecting that the access to the Internet network is available, wherein the request includes a timestamp to identify the requested metadata and excludes the geographic location information.

In Example 6, the subject matter of one or any combination of Examples 1-5 optionally includes a client application configured to perform an R-tree calculation to determine the radio broadcasts that are available to the radio receiver.

In Example 7, the subject matter of one or any combination of Examples 1-6 optionally includes a client application is configured to select the metadata from static metadata stored in the memory that is associated with the radio broadcasts available to the radio receiver.

In Example 8, the subject matter of one or any combination of Examples 1-7 optionally includes a client application configured to flag one or more portions of the metadata stored in the memory as expired after a specified time after the metadata is stored in the memory and exclude the expired metadata from the selected metadata.

Example 9 includes subject matter (or can optionally be combined with one or any combination of Examples 1-8 to include such subject matter) such as a computer readable storage medium including instructions that, when performed by processing circuitry of a radio receiver, cause the processing circuitry to perform acts comprising: determining geographic location information of the radio receiver; determining radio broadcasts that are available to the radio receiver using the geographical location information; selecting metadata, from metadata stored in memory of the radio receiver, that is associated with the radio broadcasts available to the radio receiver; and presenting information included in the selected metadata using the display according to tuning of the radio receiver.

In Example 10, the subject matter of Example 9 optionally includes a computer readable storage medium including instructions that cause the processing circuitry to perform acts comprising: detecting when Internet access is available; and downloading metadata via an Internet network interface of the radio receiver for storing in the memory of the radio receiver in response to detecting that Internet access is available.

In Example 11, the subject matter of Example 10 optionally includes a computer readable storage medium including instructions that cause the processing circuitry to perform acts comprising: receiving a prompt at the receiver to download the metadata via an Internet network interface of the radio receiver, and downloading the metadata via the Internet network interface for storing in the memory in response to the prompt.

In Example 12, the subject matter of one or both of Examples 10 and 11 optionally includes a computer readable storage medium including instructions that cause the processing circuitry to perform acts comprising sending a query for an update of metadata according to the geographic location information in response to detecting that Internet access is available, wherein the query includes a timestamp to identify metadata for the update and excludes location information of the radio receiver.

In Example 13, the subject matter of one or any combination of Examples 10-12 optionally includes a computer readable storage medium including instructions that cause the processing circuitry to perform acts comprising downloading static metadata via the Internet network interface of the radio receiver for storing in the memory of the receiver in response to the detecting that Internet access is available.

In Example 14, the subject matter of one or any combination of Examples 9-13 optionally includes a computer readable storage medium including instructions that cause the processing circuitry to perform acts comprising performing a calculation on a data set local to the radio receiver to determine the radio broadcasts that are available.

In Example 15, the subject matter of one or any combination of Examples 9-14 optionally includes a computer readable storage medium including instructions that cause the processing circuitry to perform acts comprising indicating one or more portions of the metadata stored in the memory as expired after a specified time after the metadata is stored in the memory; and excluding metadata indicated to be expired from the selected metadata.

Example 16 can include subject matter (such as a method of controlling operation of a radio broadcast receiver) or can optionally be combined with one or any combination of Examples 1-15 to include such subject matter, comprising determining geographic location information of the radio receiver; determining radio broadcasts that are available to the radio receiver using the geographic location information; sending a query to a metadata service application using an Internet network interface of the radio receiver, wherein the query requests dynamic metadata for download to the radio receiver based on identifiers included in the data stored in memory, and excludes the geographic location information for the radio receiver; selecting metadata, from metadata stored in memory of the radio receiver, that is associated with the determined radio broadcasts available to the radio receiver; and presenting information included in the received dynamic metadata and the selected metadata in memory using a display according to tuning of the radio receiver.

In Example 17, the subject matter of Example 16 can optionally include detecting when access to an Internet network is available for the radio receiver; sending the query to the metadata service application in response to detecting that the access is available; and storing downloaded dynamic metadata in the memory.

In Example 18, the subject matter of Example 17 optionally includes the radio receiver performing a calculation on a data set local to the radio receiver to determine the radio broadcasts that are available.

In Example 19, the subject matter of one or both of Examples 17 and 18 optionally includes indicating one or more portions of the metadata stored in the memory as expired after a specified time after the metadata is stored in the memory; and excluding metadata indicated to be expired from the selected metadata.

In Example 20, the subject matter of one or any combination of Examples 17-19 optionally includes sending a query that requests an update of metadata according to the determined geographic location information in response to detecting that the access to the Internet network is available, wherein the query includes a timestamp to identify the requested metadata and excludes the geographic location information.

These non-limiting examples can be combined in any permutation or combination. Many other variations than those described herein will be apparent from this document. For example, depending on the embodiment, certain acts, events, or functions of any of the methods and algorithms described herein can be performed in a different sequence, can be added, merged, or left out altogether (such that not all described acts or events are necessary for the practice of the methods and algorithms). Moreover, in certain embodiments, acts or events can be performed concurrently, such as through multi-threaded processing, interrupt processing, or multiple processors or processor cores or on other parallel architectures, rather than sequentially. In addition, different tasks or processes can be performed by different machines and computing systems that can function together.

The various illustrative logical blocks, modules, methods, and algorithm processes and sequences described in connection with the embodiments disclosed herein can be implemented as electronic hardware, computer software, or combinations of both. To clearly illustrate this interchangeability of hardware and software, various illustrative components, blocks, modules, and process actions have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of this document.

The various illustrative logical blocks and modules described in connection with the embodiments disclosed herein can be implemented or performed by a machine, such as a general purpose processor, a processing device, a computing device having one or more processing devices, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor and processing device can be a microprocessor, but in the alternative, the processor can be a controller, microcontroller, or state machine, combinations of the same, or the like. A processor can also be implemented as a combination of computing devices, such as a combination of a DSP and a microprocessor, a plurality of microprocessors, one or more microprocessors in conjunction with a DSP core, or any other such configuration.

Embodiments of the in-vehicle live guide generation system and method described herein are operational within numerous types of general purpose or special purpose computing system environments or configurations. In general, a computing environment can include any type of computer system, including, but not limited to, a computer system based on one or more microprocessors, a mainframe computer, a digital signal processor, a portable computing device, a personal organizer, a device controller, a computational engine within an appliance, a mobile phone, a desktop computer, a mobile computer, a tablet computer, a smartphone, and appliances with an embedded computer, to name a few.

Such computing devices can be typically be found in devices having at least some minimum computational capability, including, but not limited to, personal computers, server computers, hand-held computing devices, laptop or mobile computers, communications devices such as cell phones and PDA's, multiprocessor systems, microprocessor-based systems, set top boxes, programmable consumer electronics, network PCs, minicomputers, mainframe computers, audio or video media players, and so forth. In some embodiments the computing devices will include one or more processors. Each processor may be a specialized microprocessor, such as a digital signal processor (DSP), a very long instruction word (VLIW), or other microcontroller, or can be conventional central processing units (CPUs) having one or more processing cores, including specialized graphics processing unit (GPU)-based cores in a multi-core CPU.

The process actions or operations of a method, process, or algorithm described in connection with the embodiments disclosed herein can be embodied directly in hardware, in a software module executed by a processor, or in any combination of the two. The software module can be contained in computer-readable media that can be accessed by a computing device. The computer-readable media includes both volatile and nonvolatile media that is either removable, non-removable, or some combination thereof. The computer-readable media is used to store information such as computer-readable or computer-executable instructions, data structures, program modules, or other data. By way of example, and not limitation, computer readable media may comprise computer storage media and communication media.

Computer storage media includes, but is not limited to, computer or machine readable media or storage devices such as Blu-ray discs (BD), digital versatile discs (DVDs), compact discs (CDs), floppy disks, tape drives, hard drives, optical drives, solid state memory devices, RAM memory, ROM memory, EPROM memory, EEPROM memory, flash memory or other memory technology, magnetic cassettes, magnetic tapes, magnetic disk storage, or other magnetic storage devices, or any other device which can be used to store the desired information and which can be accessed by one or more computing devices.

A software module can reside in the RAM memory, flash memory, ROM memory, EPROM memory, EEPROM memory, registers, hard disk, a removable disk, a CD-ROM, or any other form of non-transitory computer-readable storage medium, media, or physical computer storage known in the art. An exemplary storage medium can be coupled to the processor such that the processor can read information from, and write information to, the storage medium. In the alternative, the storage medium can be integral to the processor. The processor and the storage medium can reside in an application specific integrated circuit (ASIC). The ASIC can reside in a user terminal. Alternatively, the processor and the storage medium can reside as discrete components in a user terminal.

The phrase "non-transitory" as used in this document means "enduring or long-lived". The phrase "non-transitory computer-readable media" includes any and all computer-readable media, with the sole exception of a transitory, propagating signal. This includes, by way of example and not limitation, non-transitory computer-readable media such as register memory, processor cache and random-access memory (RAM).

The phrase "audio signal" is a signal that is representative of a physical sound.

Retention of information such as computer-readable or computer-executable instructions, data structures, program modules, and so forth, can also be accomplished by using a variety of the communication media to encode one or more modulated data signals, electromagnetic waves (such as carrier waves), or other transport mechanisms or communications protocols, and includes any wired or wireless information delivery mechanism. In general, these communication media refer to a signal that has one or more of its characteristics set or changed in such a manner as to encode information or instructions in the signal. For example, communication media includes wired media such as a wired network or direct-wired connection carrying one or more modulated data signals, and wireless media such as acoustic, radio frequency (RF), infrared, laser, and other wireless media for transmitting, receiving, or both, one or more modulated data signals or electromagnetic waves. Combinations of the any of the above should also be included within the scope of communication media.

Further, one or any combination of software, programs, computer program products that embody some or all of the various embodiments of the in-vehicle live guide generation system and method described herein, or portions thereof, may be stored, received, transmitted, or read from any desired combination of computer or machine readable media or storage devices and communication media in the form of computer executable instructions or other data structures.

Embodiments of the in-vehicle live guide generation system and method described herein may be further described in the general context of computer-executable instructions, such as program modules, being executed by a computing device. Generally, program modules include routines, programs, objects, components, data structures, and so forth, which perform particular tasks or implement particular abstract data types. The embodiments described herein may also be practiced in distributed computing environments where tasks are performed by one or more remote processing devices, or within a cloud of one or more devices, that are linked through one or more communications networks. In a distributed computing environment, program modules may be located in both local and remote computer storage media including media storage devices. Still further, the aforementioned instructions may be implemented, in part or in whole, as hardware logic circuits, which may or may not include a processor.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While the above detailed description has shown, described, and pointed out novel features as applied to various embodiments, it will be understood that various omissions, substitutions, and changes in the form and details of the devices or algorithms illustrated can be made without departing from the scope of the disclosure. As will be recognized, certain embodiments of the inventions described herein can be embodied within a form that does not provide all of the features and benefits set forth herein, as some features can be used or practiced separately from others.

What is claimed is:

1. A radio receiver comprising:
- radio frequency (RF) receiver circuitry configured to receive an over-the-air radio broadcast signal;
- an Internet network interface;
- a display;
- a memory;
- processing circuitry; and
- a client application configured to:
  - determine geographic location information of the radio receiver;
  - determine radio broadcasts that are available to the radio receiver using the geographical location information;
  - detect when access to an Internet network is available;
  - initiate sending a query to a metadata service application via the Internet interface in response to the detecting that Internet access is available, wherein the query requests metadata for download to the radio receiver and excludes the geographic location information for the radio receiver;
  - select stored metadata, from metadata stored in the memory, that is associated with the radio broadcasts available to the radio receiver; and
  - present information included in the selected stored metadata using the display according to the received over-the-air radio broadcast signal.

2. The radio receiver of claim 1, wherein the client application is configured to:
- initiate downloading of metadata without radio broadcast data via the Internet network interface; and
- store downloaded metadata in the memory in response to detecting that access to the Internet network is available.

3. The radio receiver of claim 2, wherein the client application is configured to initiate downloading of metadata via the Internet network interface and storing of downloaded metadata in the memory in response to a prompt received at the radio receiver.

4. The radio receiver of claim 1, wherein the client application is configured to perform a calculation on a data set local to the radio receiver to determine the radio broadcasts that are available to the radio receiver.

5. The radio receiver of claim 1, wherein the client application is configured to select the metadata from static metadata stored in the memory that is associated with the radio broadcasts available to the radio receiver.

6. The radio receiver of claim 1, wherein the client application is configured to flag one or more portions of the metadata stored in the memory as expired after a specified time after the metadata is stored in the memory and exclude the expired metadata from the selected metadata.

7. A radio receiver comprising:
- radio frequency (RF) receiver circuitry configured to receive an over-the-air radio broadcast signal;
- an Internet network interface;
- a display;
- a memory;
- processing circuitry; and
- a client application configured to
  - determine geographic location information of the radio receiver;
  - determine radio broadcasts that are available to the radio receiver using the geographical location information;
  - detect when access to an Internet network is available;
  - send a request to a metadata service application via the Internet interface for an update of metadata according to the determined geographic location information in response to detecting that the access to the Internet network is available, wherein the request includes a timestamp to identify the requested metadata and excludes the geographic location information;
  - select stored metadata, from metadata stored in the memory, that is associated with the radio broadcasts available to the radio receiver; and
  - present information included in the selected stored metadata using the display according to the received over-the-air radio broadcast signal.

8. A non-transitory computer readable storage medium including instructions that, when performed by processing circuitry of a radio receiver, cause the processing circuitry to perform acts comprising:
- determining geographic location information of the radio receiver;
- determining over-the-air radio broadcasts that are available to the radio receiver using the geographical location information;
- detecting when Internet access is available;
- sending a query for an update of metadata according to the geographic location information in response to detecting that Internet access is available, wherein the query excludes location information of the radio receiver;
- selecting stored metadata, from metadata stored in memory of the radio receiver, that is associated with the radio broadcasts available to the radio receiver; and
- presenting information included in the selected stored metadata using the display according to tuning of the radio receiver to an over-the-air radio broadcast signal.

9. The non-transitory computer readable storage medium of claim 8, including instructions that cause the processing circuitry to perform acts comprising downloading metadata via an Internet network interface of the radio receiver for storing in the memory of the radio receiver without radio broadcast data in response to detecting that Internet access is available.

10. The non-transitory computer readable storage medium of claim 9, including instructions that cause the processing circuitry to perform acts comprising:

receiving a prompt at the receiver to download the metadata via an Internet network interface of the radio receiver; and downloading the metadata via the Internet network interface for storing in the memory in response to the prompt.

11. The non-transitory computer readable storage medium of claim 9, including instructions that cause the processing circuitry to perform acts comprising including a timestamp in the query to identify metadata for the update.

12. The non-transitory computer readable storage medium of claim 9, including instructions that cause the processing circuitry to perform acts comprising downloading static metadata via the Internet network interface of the radio receiver for storing in the memory of the receiver in response to the detecting that Internet access is available.

13. The non-transitory computer readable storage medium of claim 8, including instructions that cause the processing circuitry to perform acts comprising performing a calculation on a data set local to the radio receiver to determine the radio broadcasts that are available.

14. The non-transitory computer readable storage medium of claim 8, including instructions that cause the processing circuitry to perform acts comprising indicating one or more portions of the metadata stored in the memory as expired after a specified time after the metadata is stored in the memory; and excluding metadata indicated to be expired from the selected metadata.

15. A method of operating a radio broadcast receiver, the method comprising:

determining geographic location information of the radio receiver;

determining radio broadcasts that are available to the radio receiver using the geographic location information;

sending a query to a metadata service application using an Internet network interface of the radio receiver, wherein the query requests dynamic metadata for download to the radio receiver based on identifiers included in the data stored in memory, and excludes the geographic location information for the radio receiver;

selecting metadata, from metadata stored in memory of the radio receiver, that is associated with the determined radio broadcasts available to the radio receiver; and presenting information included in the received dynamic metadata and the selected metadata in memory using a display according to tuning of the radio receiver.

16. The method of claim 15, including:

detecting when access to an Internet network is available for the radio receiver;

sending the query to the metadata service application in response to detecting that the access is available; and storing downloaded dynamic metadata in the memory.

17. The method of claim 16, wherein determining the radio broadcasts that are available to the radio receiver includes the radio receiver performing a calculation on a data set local to the radio receiver to determine the radio broadcasts that are available.

18. The method of claim 16, including;

indicating one or more portions of the metadata stored in the memory as expired after a specified time after the metadata is stored in the memory; and excluding metadata indicated to be expired from the selected metadata.

19. The method of claim 16, wherein sending the query includes sending a query that requests an update of metadata according to the determined geographic location information in response to detecting that the access to the Internet network is available, wherein the query includes a timestamp to identify the requested metadata and excludes the geographic location information.

* * * * *